US009179785B2

(12) United States Patent
Tricault et al.

(10) Patent No.: US 9,179,785 B2
(45) **Date of Patent: *Nov. 10, 2015**

(54) SELF-DEPLOYABLE COT

(75) Inventors: Jeröme Tricault, Langoiran (FR); Emmanuel Sordoillet, Anglet (FR)

(73) Assignee: SERPOLET, Langoiran (FR)

( * ) Notice: Subject to any disclaimer, the term of this patent is extended or adjusted under 35 U.S.C. 154(b) by 311 days.

This patent is subject to a terminal disclaimer.

(21) Appl. No.: 13/495,384

(22) Filed: Jun. 13, 2012

(65) Prior Publication Data

US 2012/0317716 A1 Dec. 20, 2012

(51) Int. Cl.
*A47C 7/00* (2006.01)
*A47D 9/00* (2006.01)
*A47D 7/00* (2006.01)

(52) U.S. Cl.
CPC ..... *A47D 9/005* (2013.01); *A47D 7/002* (2013.01)

(58) Field of Classification Search
CPC ..... A47D 9/00; A47D 9/005; A47D 13/061; A47D 13/063; A47D 13/06
USPC ..... 5/99.1, 93.1, 93.2, 96, 97, 98.1, 98.2, 5/98.3, 110, 114, 113, 415, 416
See application file for complete search history.

(56) References Cited

U.S. PATENT DOCUMENTS 2,916,744 A * 12/1959 May et al. ..... 5/102
5,163,461 A 11/1992 Ivanovich et al.
5,385,165 A 1/1995 Hazinski et al.
5,642,538 A * 7/1997 McAllister ..... 5/99.1
5,645,096 A * 7/1997 Hazinski et al. ..... 135/126
5,676,168 A * 10/1997 Price ..... 135/126
5,800,067 A 9/1998 Easter
5,809,592 A * 9/1998 McAllister ..... 5/99.1
D410,153 S * 5/1999 McAllister ..... D6/390
5,987,665 A * 11/1999 Simantob et al. ..... 5/98.3
6,438,772 B1 * 8/2002 Brown et al. ..... 5/99.1
6,594,840 B2 * 7/2003 Tomas et al. ..... 5/655
7,376,993 B2 * 5/2008 Myers et al. ..... 5/655
7,464,420 B2 * 12/2008 Chen et al. ..... 5/98.1

(Continued)

FOREIGN PATENT DOCUMENTS

CN 1877054 A 12/2006
CN 1891109 A 1/2007

(Continued)

OTHER PUBLICATIONS

Chinese Search Report issued in Patent Application No. 201080056598.6 dated May 27, 2014.

(Continued)

*Primary Examiner* — Timothy D Collins
*Assistant Examiner* — Richard G Davis
(74) *Attorney, Agent, or Firm* — Sughrue Mion, PLLC

(57) ABSTRACT

A self-deployable device for a child (1), comprising an arcuate structure (110, 120) adapted to support at least one flexible material wall (20) defining a space for receiving a child and at least four stiffener bars (201, 201') for countering pressing down on the arcuate structure. For at least one of said bars, only one end (211, 211') of the two ends of the bar is fastened to the arcuate structure by a fixed connection so that said bar may remain connected to the arcuate structure when said structure goes from the folded state to the deployed state and/or vice-versa.

10 Claims, 4 Drawing Sheets

(56) References Cited

U.S. PATENT DOCUMENTS

| | | | | |
|---|---|---|---|---|
| D640,483 | S * | 6/2011 | Daley et al. | D6/390 |
| 7,971,596 | B2 * | 7/2011 | Morris et al. | 135/96 |
| 8,474,071 | B2 | 7/2013 | Tricault et al. | |
| 2003/0070228 | A1 * | 4/2003 | Hsia | 5/93.1 |
| 2005/0011004 | A1 * | 1/2005 | Favorito (nee Wilkins) et al. | 5/94 |
| 2006/0117478 | A1 | 6/2006 | Cheung | |
| 2007/0006910 | A1 | 1/2007 | Chu et al. | |
| 2010/0017959 | A1 | 1/2010 | Yoshe et al. | |

FOREIGN PATENT DOCUMENTS

| | | |
|---|---|---|
| FR | 2 953 701 A1 | 6/2011 |
| GB | 2 451 651 A | 2/2009 |
| WO | 00/26488 A1 | 5/2000 |

OTHER PUBLICATIONS

International Search Report for PCT/FR2010/052746 dated Apr. 27, 2011.

* cited by examiner

SELF-DEPLOYABLE COT

The present invention concerns the field child beds or cots or cribs and more particularly transportable cots.

There are classically known travels cots or fold-up cots ("lits parapluie" in French), forming a lying down space defined by a substantially rectangular surface. The lying down space is delimited by substantially vertical flexible walls retained in place by uprights at the four corners of the lying down space. The uprights are retained in place by crossed tubes at their base and by four tubes connected to the upper ends. These fold-up cots generally include a safety device for preventing accidental folding of the bed.

However, these fold-up cots are heavy to transport, bulky even when folded, complicated to use and above all complicated to fold up.

Also known are baby beds, and more particularly cribs, the retaining structure of the lying down space of which takes the form of an arch.

These baby bed have a major disadvantage in that, when the child grows and seeks to press down on the structure, which collapses, the child is then able to leave the lying down space.

U.S. Pat. No. 5,809,592 describes a child's playpen comprising two flexible loops, two vertical support bars each connecting the loops to each other, and a horizontal bar between two ends of the same loop. These bars are fixed to the loops in a removable manner. The bars may thus be fixed each time the playpen is set up and removed after each use.

There exists a need for a children area device that is easier to set up and/or to dismantle.

There is proposed a self-deployable children area device, comprising an arcuate structure comprising two hoop ends, said structure being such that in the deployed state said hoop ends are upright and able to support at least one flexible material wall defining a space for receiving a child. For each hoop end, at least two stiffener bars allow to withstand a bearing against said hoop end. The device can therefore be arranged such that in the deployed state the two bars enable pressing down forces on the corresponding hoop end to be absorbed. For at least one (and preferably for each) of said bars, only one of the two ends of the bar is fastened to the arcuate structure by a fixed connection so that said at least one bar may remain connected to the arcuate structure (or hoop structure) when said structure goes from the folded state to the deployed state and/or vice-versa.

For example, the other end, called the free end, may thus be secured to the structure by a reversible connection. For example, the connection may be made by locking and/or undone by unlocking, i.e. the user for example unfastens the free end from the structure by releasing a locking element, or the connection may more simply be made and/or undone by movement of the bar.

The free end is advantageously not fastened to the rest of the structure. The bar is thus fixed by one end, the other remaining free. The free end may for example be provided with a non-slip coating of the rubber type in order to assure good engagement with the floor or other.

Accordingly, thanks to the fixing of one end and to the reversible character of the (or the absence of) fixing of the other end of the bar to the arcuate structure, the setting up and/or storage of the device is facilitated. The bar may as it were follow the hoop structure when the latter goes from the deployed state to the folded state and/or vice-versa, which enables avoidance of steps of positioning the whole of the bar during installation of the device and of removal of the bar during stowage.

By "self-deployable" is meant that the device is adapted to be folded, notably to store it and/or to transport it, but that its equilibrium position in the absence of constraints is the deployed state.

The presence of two stiffener bars at each hoop end enables a relatively high resistance to pressing down to be achieved.

The fixed connection fastening the non-free end of the bar to the structure is normally designed so that the user is incapable of undoing this connection under normal conditions of use. A connection may be provided that can be undone occasionally, for example to enable repair or changing of parts, provided that the device is adapted so that during deployment and/or folding the stiffener bar may remain fastened to the hoop structure. The device is thus arranged such that the bar does not constitute an obstacle to deploying and/or folding the structure. The presence of stiffeners bars is thus less of a constraint for the user when deploying and/or folding the device than in the prior art.

The bearing that the bar may be able to withstand may for example be caused by a child seeking to exit the space dedicated to him/her by rocking the device.

In the deployed state, the bar makes it possible to reinforce the structure, notably by playing a stiffening role, and may enable bearing against the arcuate structure to be withstood by abutting against a floor element. The floor element may for example be the floor itself, a base loop designed to be placed on the floor, a flexible material wall supported by the base loop, etc.

The bar may be in contact with the floor element permanently or quasi-permanently when the device is in the deployed state or only if it is pressed down on. In the latter case, the free end of the bar may be a few centimeters from the floor element when it is not pressed down on.

The device described above may furthermore be free of exterior points as may be found in a tent or a hammock, for example, such as tent pegs.

The free end may for example be directly fastened by a reversible connection to one or more hoops (or archs) of the arcuate structure, for example a base loop designed to rest entirely on the floor, or to a flexible material wall supported by one or more hoops, for example a flexible material wall supported by the base loop or a flexible material wall that is upright in the deployed state, supported by a hoop that is upright in the deployed state.

In the case of unfastening the free end from the structure by movement of the bar, this movement may be effected by a user in order to fold up the device or the bar may be undone of its own accord if it is not pressed down on and remain in the free state for example a few centimeters from any floor element. If the movement is effected by a user, the device may be such that the user expressly pulls on the bar in order to undo the connection between the free end and the hoop structure. Alternatively, the device may be such that the bar is entrained by the rest of the structure during folding, which may enable specific movement of the stiffener bar by the user to be avoided.

Similarly, when the free end is fastened to the structure by movement of the bar, that movement may be effected expressly by a user or result from movements of the hoop structure during deployment. When the bar remains at a distance from the floor element when not pressed down on, fastening may occur only in the event of being pressed down on, for example by a child.

The device may advantageously include guide means for guiding the free end of the bar when the device goes from the deployed state to the folded state and/or vice-versa. These guide means may enable correct positioning of the stiffener bar to be assured and consequently user gestures to be limited.

The guide means may be produced for example in flexible material thus enabling the weight of the device to be limited. These guide means may for example include a flexible material sheath sewn to a flexible material wall of the device, for example a vertical wall.

The invention is in no way limited to flexible material guide means. There may for example be provision for guiding the bar in a cylindrical plastic or metal element.

The device may advantageously be adapted to define at least one housing to receive the free end of the bar in the deployed position. Such a housing, open at one or both ends, can enable correct positioning of the bar to be assured in the deployed position. This housing may for example be formed by an eyelet in the flexible material wall on the floor, supported by the base loop, or formed by an opening, a buttonhole etc., in the base loop, or formed in an upright flexible material wall, etc. The eyelet may have edges of flexible or rigid material.

The housing may include an eyelet so that the structure is relatively simple but the invention is in no way limited to housings of this type. In particular, the housing may be formed by relatively high guide walls, for example more than 2.5 or 10 centimeters high, adapted to cover a portion of the stiffener bar. Such a housing may be formed in flexible material: there may for example be provided a canvas pocket sewn to an upright flexible material wall and disposed so that the bottom of the pocket reaches a floor element in the event of pressing down. Alternatively, this housing may be in a rigid material: there may for example be provided a metal or plastic cylindrical element the base of which is fixed to a base hoop designed to rest entirely on the floor, and the inside diameter of which is slightly greater than a diameter of the stiffener bar, so that this bar can be received in the cylindrical element.

The hoop structure may advantageously be held in the deployed position by extension maintaining means adapted to counter forces tending to move apart elements of the structure. The extension maintaining means may notably enable forces exerted by the structure to be countered. The structure may have a tendency to open naturally because of its conformation. The forces may also be caused by a person seeking to push the elements of the structure out of the child space, for example a child inside or outside that space.

In particular, the extension maintaining means may comprise at least the flexible material wall adapted to retain the structure. The flexible material wall may be associated with a strap for consolidating the assembly.

The invention is not limited by the shape of the hoop structure employed.

The hoop structure may advantageously include at least one first hoop forming a base loop adapted to rest on the floor and at least one second hoop, upright in the deployed position, which is substantially U-shaped as seen from the front, the second hoop being adapted to support at least the flexible material wall.

In particular, there may be provided two pairs of stiffener bars respectively fastened in the vicinity of the two top points of the second hoop.

In the deployed state, the space for receiving a child is advantageously defined by one or more walls substantially vertical relative to the floor and/or relative to the base loop. By "substantially" is meant to within 10% and advantageously to within 5%.

The child space may for example be circumscribed between four substantially vertical walls and a bottom, the side opposite the bottom remaining open or possibly closed for example by a mosquito net.

The hoops may be rounded along their whole length, as represented in the figures described herein after, or not.

For example, an arch may comprise rounded portion(s) and straight portion(s), in particular at the hoop ends of the upright hoop.

For example, the upright hoop may have a shape such that when the device is deployed, the straight portions at the two hoop ends are on the same level as the walls upper rims (referenced 700 in the figures described herein below), such that the upper outline of the device is substantially plane, with for example a rectangular shape, as usual for child cots.

The device may be a cot and the space may be a lying down space. The lying down space may be conformed to authorize the installation of a mattress with substantially rectangular faces.

Alternatively, the device could be a playpen for children and the space a playing space.

There is further proposed a self-deployable device for child with an arcuate structure adapted to support in a deployed position at least one flexible material wall defining a receiving space. The device advantageously includes flexible material wall reinforcing means for countering pressing down on this wall. The child may seek to leave the space dedicated to them by straddling the wall, for example, and these reinforcing means can enable stiffening of the wall and limiting of collapse, notably if the flexible material has aged.

These means may advantageously include one or more bars fastened to the wall. There may for example be provided a reinforcing bar that is substantially horizontal when the device is deployed, disposed in the vicinity of an upper edge of the wall, and at least one, advantageously two, substantially vertical reinforcing bars disposed so as to abut on the one hand on the substantially horizontal bar and on the other hand on a floor element if the substantially horizontal bar is pressed down on. The reinforcing means may thus be fitted in a relatively simple manner, without modifying the flexible material itself.

The presence of two or more reinforcing bars may enable the structure to be made more resistant to collapse.

The bar or each bar of the reinforcing means advantageously has a length less than or equal to the maximum dimension of the device in the folded state. Accordingly, if the bar or bars are judiciously disposed, the passage from the deployed state to the folded state and/or vice-versa may be effected without any step dedicated to the reinforcing means, of the bar fixing or other type.

The deployable structure defined in this way is lighter than a traditional fold-up cot and also responds better than a baby bed should the child press down on it.

There is further proposed a self-deployable device for a child with an arcuate structure adapted to support in a deployed position at least one flexible material wall defining a receiving space. The device may advantageously further comprise at least one supplementary bar, and advantageously two supplementary bars disposed on respective opposite sides of the child space. The supplementary bar or bars may be disposed obliquely when the device is in the deployed state, i.e. that may form a non-zero angle with the vertical wall, and so as to be able to counter forces pressing down on the wall with a horizontal component.

For at least one supplementary bar, this bar advantageously extends between the substantially horizontal bar of the reinforcing means and a floor element, advantageously the junction between the two hoops at floor level.

The supplementary bar or bars may thus enable tipping over of the structure to be prevented.

It is possible for the flexible material wall to delimit a second lying down space, for example for a second child.

There is further proposed a device for a child, for example a cot or other device, defining a space for receiving a child and comprising a bottom of that receiving space including two superposed flexible material walls, said bottom being adapted to be able to receive a mattress between said walls. The superposed walls may define a pocket adapted to receive a mattress.

Thus the device defines a housing to receive a mattress. Such a double bottom enables the requirements of standards relating to the fixing of the mattress to be satisfied without using dedicated fixing means of the hook and loop type (Velcro®). The mattress is simply retained between the two flexible material walls.

Installation is all the simpler in that it is not necessary to provide a cover for the mattress.

The two walls are advantageously fastened to each other over at least a portion of their perimeter, for example sewn together or fastened together by hook and loop tape or other tapes.

The pocket defined in this way may have an opening for insertion of the mattress on the floor side or on the lying down space side. Means for temporary closing this opening may optionally be provided, for example hook and loop tape or other tapes.

Providing the opening on the floor side further facilitates installation of the mattress since the user will not have to manipulate the mattress inside the lying down space.

One of the walls advantageously defines, possibly with the other wall, an opening for insertion of a mattress via this opening. The bottom is thus of relatively simple design.

Without this being limiting on the invention, it is advantageously the floor side wall that includes this opening for the insertion of a mattress. This enables even easier installation.

Although this is not limiting on the invention, one of the two bottom walls advantageously has dimensions less than the other wall. In this way it is possible to economize on the flexible material, for example cloth, and to provide a shape adapted to that of the mattress in order to prevent the mattress sliding in the space between the walls.

There may for example be provided a bottom including a first wall and a second wall with smaller dimensions than the first wall, for example of rectangular shape, and fixed to the first wall, under this first wall, by seams on three of the four sides of the rectangle. The fourth side corresponds to the opening for the insertion of the mattress into the pocket formed between the first wall and the second wall.

The pattern piece corresponding to the first and/or second wall may have edges in order for a relatively thick mattress to fit.

There could also be provided a relatively extensive second wall on the floor side in which is cut an opening for the insertion of a mattress. The first wall may then optionally have dimensions corresponding to those of the mattress.

There is further proposed a device for a child, for example a cot or other device, defining a space for receiving a child and comprising a flexible material element adapted to cover at least part of the bottom of the space for receiving a child and adapted to be detached from the device.

This flexible material detachable element may for example comprise an underblanket, a sheet, etc. This element may thus be removed in order to be washed.

This detachable element may extend over at least a portion of the bottom. There may be provided removable fixing means of the hook and loop tape, popper, zip or other type for temporary fixing of the detachable element to the rest of the device.

This detachable element may be fixed to a bottom wall that is solid or defines an opening under the detachable element.

In a preferred embodiment, the bottom includes both an opening on the floor side for the insertion of a mattress and a detachable element on the lying down space side. There could nevertheless be provision for insertion of the mattress after detaching (possibly partially detaching) the detachable portion, via an opening in the bottom wall on the lying down space side, the floor side wall then possibly having no opening.

The various above features may of course be combined.

There is further proposed a method of deploying or folding a device as described above in which during deployment or folding only one of the two ends of the bar is fastened to the hoop structure, the other of said ends being left free. The bar thus remains connected to the hoop structure when that structure goes from the folded state to the deployed state and/or vice-versa.

The invention is now described with reference to the nonlimiting drawings, in which.

Figure 1:
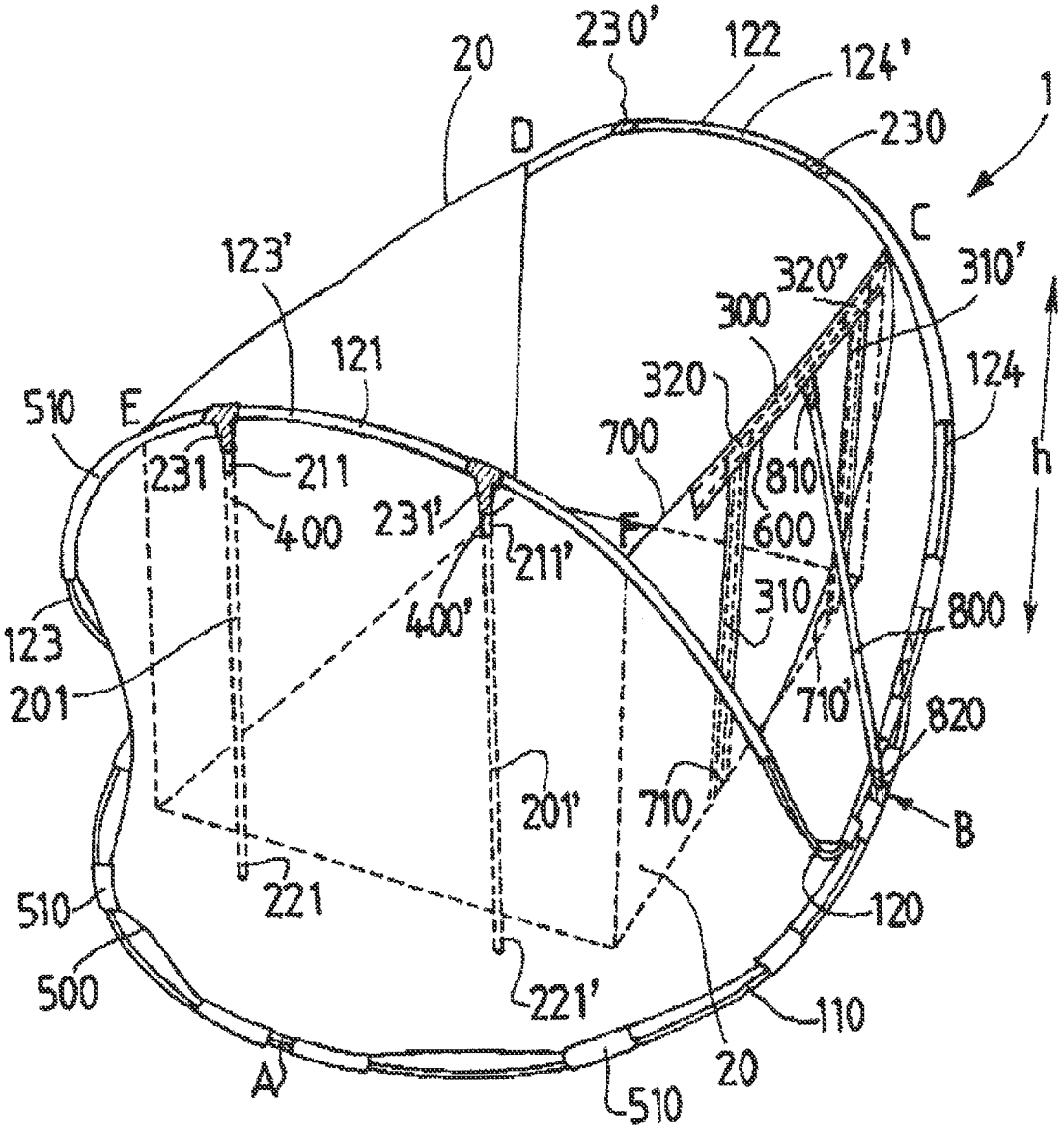
FIG. 1 and FIG. 4 are perspective views of an example of a cot according to a first embodiment of the invention, some elements not being represented in one or the other of these figures for reasons of legibility and clarity. For example, the underblanket is not represented in FIG. 1 while the stiffener bars are only very partially shown in FIG. 4.

In the nonlimiting first embodiment represented in the figures, a cot 1 is formed of a deployable arcuate structure. This structure comprises two hoops 110, 120, the first hoop 110 forming a base loop adapted to rest on the floor and the upright second hoop 120 being substantially U-shaped when seen from the front in the deployed position, with branches tending to move away from each other.

The longitudinal axes AA', BB' of these loops are substantially perpendicular to each other.

The two longitudinal ends (B, B') of the support loop 120 are associated with the two transverse ends of the base loop 110 so that the base loop 110 lies substantially in a plane and the support loop 120 forms two hoops 123, 124 the hoop ends 123', 124' of which extend upward.

The hoop ends 123', 124' notably assure the retention of a flexible wall 20 at four points C, D, E and F substantially forming a rectangle. The flexible wall is composed of one or more elements of parallelepiped shape.

In the example shown, the walls have substantially the same height h, for example 60 or 70 centimeters. In another example, not shown, the opposite sides taken two by two of the parallelepiped having similar heights, the adjoining sides being of a different height, could be imagined.

The walls are advantageously substantially perpendicular to the floor, i.e. are at an angle relative to the vertical of +/−10° or less.

The structure is held in the deployed position by the wall 20 which forms extension maintaining means acting on the hoops 123 and 124. The wall 20 enables forces tending to move the hoops 123, 124 away from each other to be countered.

The device includes four stiffener rods or bars, of which only two bars 201, 201' are visible in FIG. 1, the bars enabling with standing bearing against the hoop end 124' being concealed by a cloth wall.

These stiffener bars each have a respective first end (211, 211' for the bars 201, 201') and a respective second end (221, 221' for the bars 201, 201'). The first ends of the stiffener bars not visible in FIG. 1 are fastened in the vicinity of the top point 122 and the first ends of the bars 201, 201' are fastened in the vicinity of the top point 121. This fastening is effected by means of plastic Tees 230, 230', 231, 231'.

The vertical branches of the Tees 230, 230' respectively receive the ends of the corresponding stiffener bars that are not visible while the horizontal branches of these Tees, 230, 230' receive portions of the loop 120 in the vicinity of the top point 122. In the same fashion, the vertical branches of the Tees 231, 231' receive the ends 211, 211' while the horizontal branches of these Tees 231, 231' receive portions of the loop 120 at the level of the top point 121. The fastening of the first ends of the stiffener bars to the hoop structure is therefore permanent, the Tees 230, 230', 231, 231' not being intended to be undone by a user.

On the other hand, the second ends of the stiffener bars are merely intended to be received in respective buttonholes (222, 222' in FIG. 3) of a canvas wall 965 supported by the base loop 110.

The structure is for example composed of tubes of 5 mm diameter. The stiffener bars 201, 201' and the loops 110, 120 may be in glass fibres for example.

The base loop 110 has a length when unbent of approximately 4860 mm.

The support loop 120 has a length when unbent of approximately 4028 mm.

The structure is covered by an envelope 500 made up from at least six different pattern pieces. A pattern piece may be used for more than one piece. The device is produced from:

- A substantially rectangular first pattern piece corresponding to the sides of the lying down space and a second pattern piece that is also substantially rectangular, but of smaller size, corresponding to the edges of the lying down space.
- A third pattern piece and a fourth pattern piece adapted to close the surfaces extending between the sides of the lying down space and the hooped support loop 120, the shape of which is delimited by the chord of a circle and its periphery. By way of example, the third pattern piece has a chord of 600 mm and a height of 158 mm and the fourth pattern piece has a chord of 1653 mm and a height of 207 mm.
- A fifth pattern piece, adapted to close the exterior surfaces of the structure extending between the points 121, A, B and B' and its symmetrical counterpart 122, A', B and B'.
- A substantially oval sixth pattern piece adapted to close the bottom of the structure, having the following dimensions: 1500 mm between the points A and A' and 1000 mm between the points B and B'. As explained hereinafter, there is further provided a rectangular pattern piece for defining with the sixth pattern piece a pocket for receiving a mattress 900 (see FIG. 3).

To all these pattern pieces it is necessary to add the seam allowances necessary for assembly, which may for example extend between 20 mm and 30 mm.

The envelope 500 is supported by the hoop structure by means of canvas sleeves 510.

The deployable structure 110, 120 described in FIG. 1 is advantageously a self-deploying structure well known to the person skilled in the art.

The hoops, once folded by a method well known to the person skilled in the art, form a circle with a diameter from 60 to 90 cm diameter.

To each of the two first pattern pieces there is sewn a pocket 600 for receiving a horizontal reinforcing bar 300 and two vertical reinforcing bars 310, 310'. These bars each have a length such that these bars 300, 310, 310' do not constitute an impediment to folding, for example 60 centimeters. In FIG. 1, the pocket and the reinforcing bars are visible for only one of the two first pattern pieces.

The distance between the points F and C may for example be approximately 1 meter. The person skilled in the art will understand that the figures are not necessary to scale and will know how to make any necessary adaptations.

The device 1 further comprises two oblique bars, of which only one bar 800 is visible in FIG. 1, for countering a force pressing down on the bar 300 having a horizontal component. Each of these oblique bars is fastened on the one hand to the corresponding horizontal reinforcing bar, by means of a plastic Tee for example, and on the other hand to one and/or the other of the loops 110, 120, at the level of the junction of those loops, again by means of a plastic Tee. Thus the bar 800 is fastened to the bar 300 by a plastic Tee 810 and to the point B of the base loop 110 by a plastic Tee 820.

This Tee 820 may also serve to fasten the loops 110, 120 to each other.

The person skilled in the art will understand that the folding of the hoops, well known in itself, is not inconvenienced by the presence of the bars 300, 310', 210, 210', 800, and their counterparts that are not visible in FIG. 1. The reinforcing bars are fixed to the upper hoop with the aid of plastic Tees 230, 230', 231, 231' and each has an end left free. The bars 300, 310, 310', 800 are situated at locations where folding is not interrupted and therefore in no way impede folding. This system enables automatic placement on deployment and folding without necessitating any demounting or unlocking action on the part of the user. During the deployment and folding phases, the user has only the "pop up" system to manage, i.e. to form an 8 with the two hoops for folding. All the additional stiffening elements 300, 310, 310', 210, 210', 800 are placed and folded automatically.

The bars 300, 310', 310, here in glass fibres, are fastened together by plastic Tees 320, 320'. Seams not represented in FIG. 1 enable retention in place of the bars 300, 310, 310'.

The vertical bars 310, 310' each have one end fastened to the horizontal bar 300 and the other end 710, 710' situated a few centimeters from the bottom of the lying down space. If the child presses down on the upper rim 700, this other end 710, 710' comes into abutting engagement and enables forces linked to this pressing down to be countered.

Alternatively, in an embodiment that is not shown, there may be provision for the low end of the vertical bars to reach the bottom of the wall, or even to extend as far as the floor by passing through eyelets formed in the envelope. For example, the height h of the walls may be 60 cm and the length of the vertical bars may also be equal to approximately 60 cm. In this case, there may be provision for the horizontal bar to be retained in a hem at the upper edge.

In an embodiment that is not shown, there could be provided a single vertical bar of the 310 type per wall, or three, or a greater number.

Returning to FIG. 1, the second pattern pieces each include two openings (400, 400' for those visible in FIG. 1) to enable the corresponding stiffener bar (201, 201') to pass through them.

For greater clarity, in FIG. 1 the pocket 600 is represented as being on the outside, but it is clear that for aesthetic reasons it may be advantageous to place it inside the envelope.

Also, for greater clarity, there have been represented completely in FIG. 1 only two of the four stiffener bars, only one of the two horizontal reinforcing bars, only two of the four vertical reinforcing bars, only one of the two oblique bars, etc. It will be understood that on the other side of the lying down space there are found elements similar to those explicitly represented in the figure.

Figure 2:
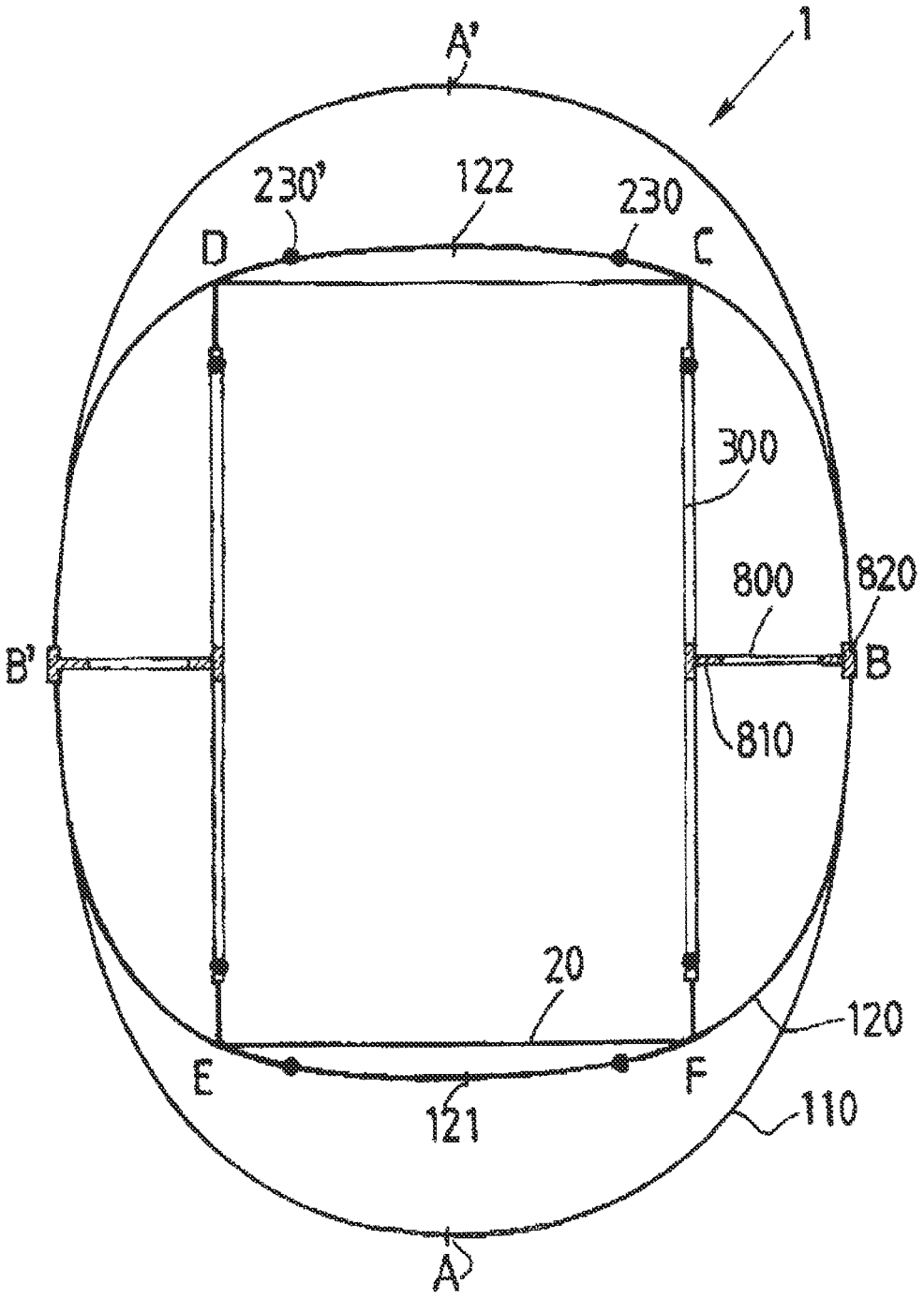
FIG. 2 is a top view of a structure of a cot according to the first embodiment, represented in a highly diagrammatic fashion.

FIG. 2 shows the hoop structure of the bed 1 with the loops 110, 120 and the walls 20 that define a lying down space for a child.

Figure 3:
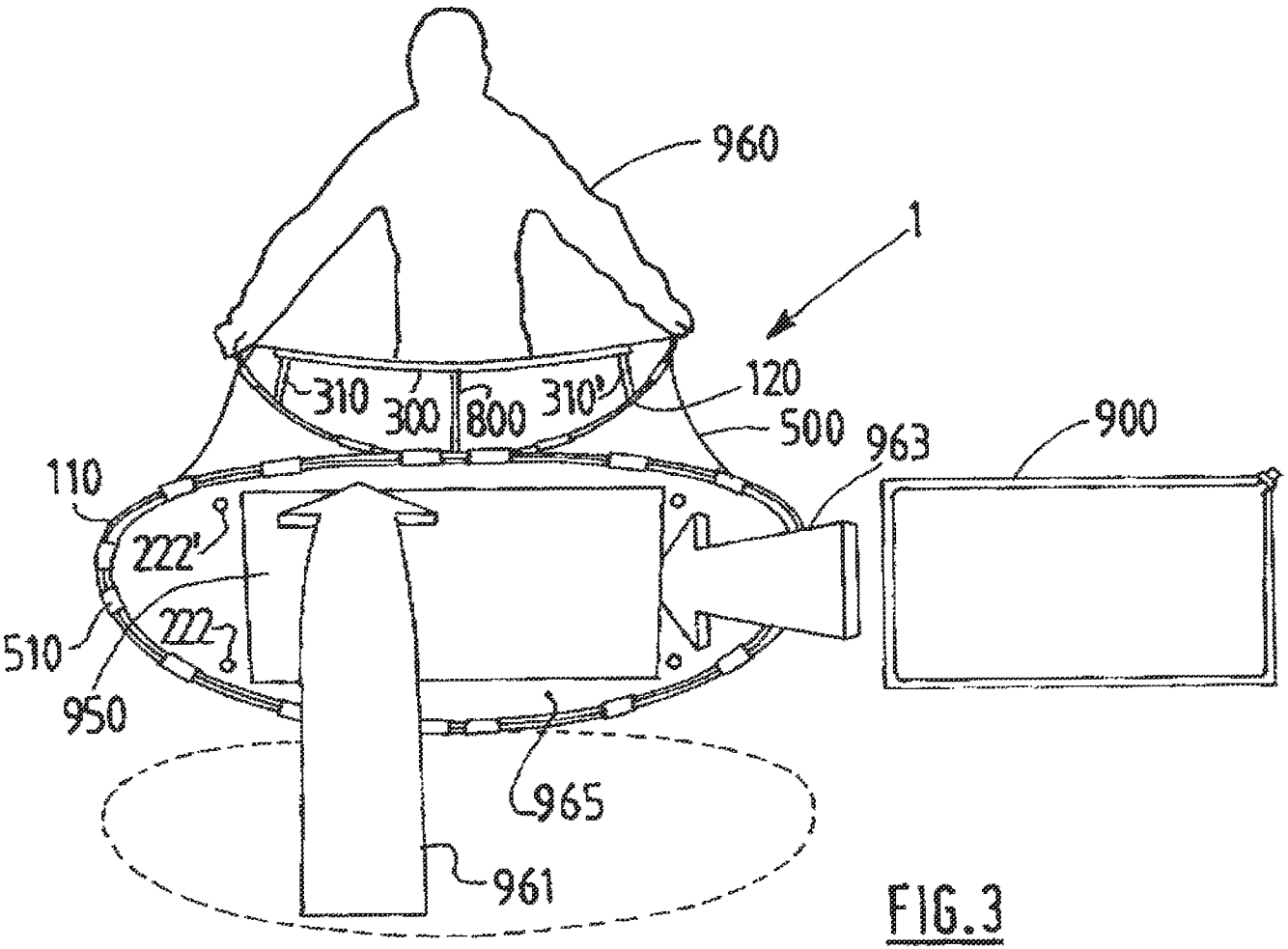
FIG. 3 illustrates the installation of an inflatable mattress in a cot according to the first embodiment.

FIG. 3 illustrates the installation of a mattress 900. A user 960 first causes the bed 1 to tilt as shown by the arrow 961, so as to raise from the floor the bottom 950, 965 of the bed 1. The mattress 900 is then inserted in the deflated state into an opening 962 defined between the cloth rectangle 950 and the oval sixth pattern piece 965, as shown by the arrow 963.

A rectangular pattern piece 950 may be sewn to an oval pattern piece 965 to leave an opening 962 for the insertion of a mattress. There will be provided for example seams on only three of the four sides of the rectangle.

Alternatively, the floor side wall could be in one piece and pierced by an opening for insertion of the mattress. The lying down space side wall could be fixed to the floor side wall by seams forming a rectangle with dimensions slightly greater than those of the mattress. The mattress is thus received via the opening in the floor side wall, between the two superposed walls that form the bottom of the lying down space.

The invention is not limited to a particular shape of the bottom, although it is advantageous for this bottom to define a housing to receive the mattress.

The mattress is inserted in the deflated state and inflated once in place, using inflation means known to the person skilled in the art.

Figure 4:
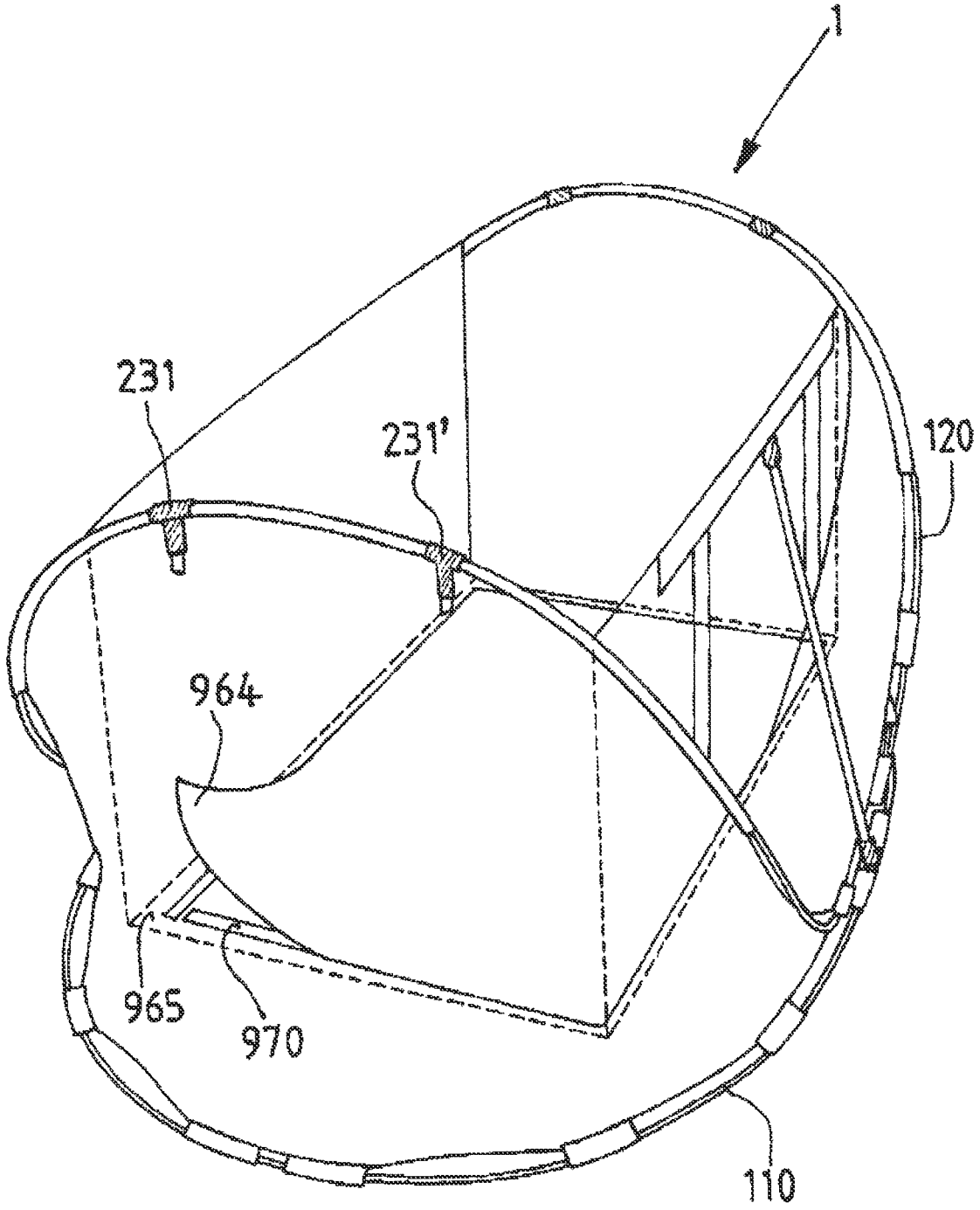

As shown in FIG. 4, a detachable element 964, for example an underblanket, is fixed to the wall 965, on the lying down space side, by hook and loop tapes 970 or other removable fixing means. After a few uses, or if the child has soiled this underblanket 964, it is possible to remove the underblanket 964 and to wash it separately from the rest of the envelope 500.

Alternatively there could be provision for the low end of each stiffener bar to be guided during deployment by the user or by guide means of the sheath type in a receiving element with an opening having an inside diameter slightly greater than the outside diameter of the bar. This introduction initiates a movement of a locking element of the receiving element, this movement leading to immobilization of the bar. This locking element may be located at the level of the passage for the bar and may for example include a spring and a recessed part adapted to be pushed by the spring. The recess of the recessed part has substantially the same diameter as that of the receiving element. In the locked position, because of the thrust of the spring, the recessed part applies transverse forces against the corresponding stiffener bar portion, these forces being sufficient to prevent withdrawal of the bar or to make it more difficult. During folding, the user presses on a protruding end of the recessed part that constitutes a sort of button. The pressing down force being in the direction opposite to that of the thrust of the spring, the recessed part is moved. When the recess of the recessed part is substantially aligned with the recess of the receiving element and the recessed part applies to the bar a sufficiently low force, the bar may be withdrawn more easily by the user or by virtue of the entrainment linked to the folding of the structure.

In the present application, the terms "top", "bottom", "upper", "lower", "horizontal", "vertical" are to be understood in the normal sense of the term, when the deployed device lays on a floor, the floor being supposed horizontal or substantially horizontal, low and bottom with regard to the deployed device placed on the floor. The device may of course be tilted, lifted, etc., in particular when the mattress is installed.

The invention claimed is:

1. A self-deployable device for a child, comprising an arcuate structure comprising two hoop ends, said structure being such that in the deployed state said hoop ends are upright and able to support at least one flexible material wall defining a space for receiving a child, for each of said hoop ends, at least two stiffener bars to withstand bearing against said hoop ends, wherein, for at least one of said bars, only one end of the two ends of the bar is fastened to the arcuate structure by a fixed connection so that said at least one bar may remain connected to the arcuate structure when said structure goes from the folded state to the deployed state and/or vice-versa.

2. The device according to claim 1, wherein, for at least one of said stiffener bars, the other end of the ends of said bar is not fastened to the arcuate structure.

3. The device according to claim 1, further including wall reinforcing means for countering pressing down on a flexible material wall.

4. The device according to claim 3, wherein the reinforcing means include a reinforcing bar that is substantially horizontal when the device is deployed disposed in the vicinity of an upper edge of the wall and at least two substantially vertical reinforcing bars disposed so as to come, in the event of pressing down on the substantially horizontal bar, to abut on the one hand against the substantially horizontal bar and on the other hand against a floor element.

5. The device according to claim 1, further including at least one supplementary bar disposed obliquely when the device is in the deployed state to prevent the device from tipping over in the event of pressing down on the wall with a horizontal component.

6. The device according to claim 1, wherein the arcuate structure includes at least one first hoop forming a base loop adapted to rest on the floor and at least one second hoop that is upright in the deployed position and which when seen from the front is substantially U-shaped, the second hoop being adapted to support at least the flexible material wall.

7. The device according to claim 1, wherein said device is a cot.

8. The device according to claim 1, wherein said device comprises a bottom of the space for receiving a child, said bottom comprising two superposed flexible material walls defining a pocket adapted to receive a mattress, said pocket having on the floor side an opening for the insertion of the mattress.

9. The device according to claim 1, comprising a flexible material element adapted to cover at least a portion of the bottom of the space for receiving a child and means for removably fixing said flexible material element to the rest of said device.

10. A method of mounting/demounting a self-deployable device for a child comprising:

providing an arcuate structure comprising two hoop ends, said structure being such that in the deployed state said hoop ends are upright and able to support at least one flexible material wall defining a space for receiving a child, and, for each of said hoop ends, at least two stiffener bars for withstanding bearing against said hoop end, wherein, for at least one of said bars, only one end of the two ends of the bar is fastened to the arcuate structure by a fixed connection, and deploying the device during which said at least one bar remains connected to the arcuate structure by the end fastened by a fixed connection, the other end being left free.

* * * * *